US008819968B1

(12) United States Patent
Van Beek

(10) Patent No.: US 8,819,968 B1
(45) Date of Patent: Sep. 2, 2014

(54) MODULAR SOLAR POWERED ILLUMINATED ALPHANUMERIC IDENTIFICATION SYSTEM

(76) Inventor: Allen L. Van Beek, Edina, MN (US)

( * ) Notice: Subject to any disclaimer, the term of this patent is extended or adjusted under 35 U.S.C. 154(b) by 0 days.

(21) Appl. No.: 13/134,059

(22) Filed: May 27, 2011

(51) Int. Cl.
*G09F 13/22* (2006.01)

(52) U.S. Cl.
CPC ..... *G09F 13/22* (2013.01)
USPC ..... 40/544; 40/605

(58) Field of Classification Search
USPC ..... 40/544, 574, 605
See application file for complete search history.

(56) References Cited

U.S. PATENT DOCUMENTS 3,466,774 A * 9/1969 Borresen ..... 40/661.01
4,718,185 A * 1/1988 Conlin et al. ..... 40/442
5,020,253 A * 6/1991 Lie et al. ..... 40/576
5,615,502 A * 4/1997 Gabrius ..... 40/570
5,778,579 A * 7/1998 Yuen ..... 40/564
6,658,774 B1 * 12/2003 Munter et al. ..... 40/574
7,175,305 B2 * 2/2007 Martineau ..... 362/244

* cited by examiner

*Primary Examiner* — Joanne Silbermann
(74) *Attorney, Agent, or Firm* — Law Offices of Steven M. Weinrieb

(57) ABSTRACT

A modular solar powered illuminated alphanumeric identification system which incorporates solar power or other alternative power sources to illuminate light emitting diodes. The invention includes a plurality of self-powered aligned modules which is secured to a suitable surface in order to provide for visual alphanumeric identification either nonelectronically or electronically during hours of daylight and during the hours of darkness, respectively. The self-powered modules include a plurality of photovoltaic cells which charges one or more battery packs for the subsequent illumination of arrangements of alphanumerically arranged light emitting diodes during periods of darkness.

12 Claims, 16 Drawing Sheets

MODULAR SOLAR POWERED ILLUMINATED ALPHANUMERIC IDENTIFICATION SYSTEM

CROSS REFERENCES TO RELATED APPLICATIONS

None.

BACKGROUND OF THE INVENTION

1. Field of the Invention

The present invention pertains to an alphanumeric identification system, and more particularly, is for a modular alphanumeric identification system which incorporates solar power or other alternative power sources to illuminate light emitting diodes or other lighting elements or devices known to the art.

2. Description of the Prior Art

While prior art alphanumeric identification systems, especially those used as residential address numbers, business address numbers or business name displays, or even street sign verbiage offered visual acuity and readability during periods of daylight, they did little to enhance readability and clarity during low light or lightless evening conditions. Reflectorized schemes were not a suitable or viable solution because one had to provide their own light source in order to draw upon the qualities of a reflectorized surface. Clearly, what is needed is an alphanumeric identification system which is highly visible during evening hours as well as being suitably visible during daylight hours, and which beneficially provides for self-powering and self-illumination, and as a further and additional benefit is of low or nonexistent energy consumption. A steady source power backup provided in an alternative embodiment is used for periods of minimal or nonexistent solar light sources. Such systems are provided by one or more embodiments of the present invention.

SUMMARY OF THE INVENTION

The general purpose of the present invention is to provide a modular solar powered illuminated alphanumeric identification system which incorporates solar power or other alternative power sources to illuminate light emitting diodes.

According to one embodiment of the present invention, there is provided a modular solar powered illuminated alphanumeric identification system including a variable number of aligned modules each having a clear and transparent front and rear enclosure and each of the plurality of modules including multiple components which contain a printed circuit board having a numeral or letter located on the front surface of the printed circuit board and viewable through the front enclosure, a plurality of light emitting diodes (LEDs) mounted to and positioned on the front of the printed circuit board coinciding with the shape of the numeral or letter located thereon and viewable through the front enclosure, a plurality of photovoltaic cells aligned at various advantageous positions within the combined front and rear enclosure, a plurality of rechargeable battery packs, a photoelectric cell, and circuitry for charging the rechargeable battery packs and for operation of the electronic components contained therein. One alternative embodiment includes modules having light emitting diodes which can be viewed through the transparent front and/or rear enclosure where the modules mount to a channel. Another alternative embodiment includes the channel and auxiliary charging apparatus secured thereto for use with either a front or rear viewable module or with a front and rear viewable module in periods of low or nonexistent ambient light.

One significant aspect and feature of the present invention is a modular solar powered illuminated alphanumeric identification system comprised of one or more modules which display alphanumeric information nonelectronically during daylight hours and electronically during night time hours.

One significant aspect and feature of the present invention is a modular solar powered illuminated alphanumeric identification system comprised of one or more modules arranged in an array.

Another significant aspect and feature of the present invention is one or more modules having alphanumeric characters located behind transparent front enclosures which are visible in periods of daylight.

Another significant aspect and feature of the present invention is one or more modules each having light emitting diodes co-located along an alphanumeric character and located behind transparent front enclosures for use in periods of darkness.

Another significant aspect and feature of the present invention is the use of one or more photovoltaic cells to charge one or more rechargeable battery packs in a single module arranged in a three dimensional pattern to maximize collection of solar energy from solar energy sources as the sun and some other light sources emitting photons.

Another significant aspect and feature of the present invention includes the use of modules which include photovoltaic cells and a light sensitive transistor juxtaposed and aligned to a front enclosure.

Yet another significant aspect and feature of the present invention includes the use of modules which include light emitting diodes visible through a transparent front enclosure.

Another significant aspect and feature of the present invention is the use of one or more rechargeable battery packs to power a plurality of light emitting diodes arranged in the form of an alphanumeric character.

Another significant aspect and feature of the present invention is the use of ambient light sensing to discontinue illumination of the plurality of light emitting diodes during daylight hours, thereby enhancing battery pack life and duration.

Another significant aspect and feature of the present invention is the use of a timer to delay the use of the light emitting diodes during the evening transition from sunlight to darkness for battery pack conservation.

Another significant aspect and feature of the present invention is the use of front and rear enclosures which are transparent and waterproof.

Alternative embodiments provide yet other significant aspects and features of the present invention described below and herein including the use of modules which include light emitting diodes and alphanumeric characters visible through both a transparent front and rear enclosure.

Another significant aspect and feature of the present invention includes the use of modules which include photovoltaic cells juxtaposed and aligned to both a transparent front and rear enclosure.

Another significant aspect and feature of the present invention is the use of a channel for mounting one or more modules.

Another significant aspect and feature of the present invention is the use of modules having outwardly extending tabs extending from a bottom panel for engagement and fixation with a channel.

Another significant aspect and feature of the present invention is the use of an auxiliary power module which can be secured to the bottom surface of a channel.

Another significant aspect and feature of the present invention is the use of an auxiliary power module for powering of one or more modules during periods of nighttime or during periods of low ambient light.

Another significant aspect and feature of the present invention is the use of an auxiliary power module which can be mounted to either a vertical or horizontal surface.

Another significant aspect and feature of the present invention is the use of an auxiliary power module which senses low battery pack level and then subsequently charges such battery packs.

Having thus briefly described one or more embodiments of the present invention, and having mentioned some significant aspects and features of the present invention, it is the principal object of the present invention to provide a modular solar powered illuminated alphanumeric identification system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings in which like reference numerals designate like parts throughout the figures thereof and wherein.

DETAILED DESCRIPTION OF THE PREFERRED EMBODIMENTS

Figure 1:
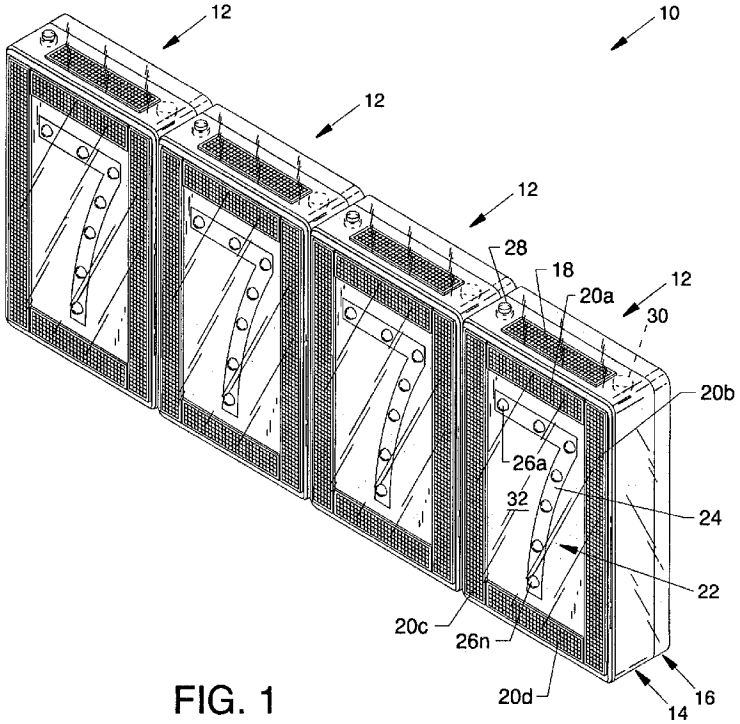
FIG. 1 is an isometric view of a modular solar powered illuminated alphanumeric identification system, the present invention.

FIG. 1 is an isometric view of a modular solar powered illuminated alphanumeric identification system 10, the present invention, including a plurality of like and similar modules 12 closely arranged side-by-side in an array where each module in such an arrangement could be removably attached, as later described, to a vertically disposed planar or other surface or location, such as, but not limited to, the side of a house, a business, a mailbox, a business location or any other desired location. Although side-by-side use is shown, the modules 12 could be staggered or placed vertically or otherwise be suitably arranged or incorporated. In this embodiment, the modules 12 are viewable from one or more vantage points, i.e., from the front as well as parallax views of the front.

Figure 2:
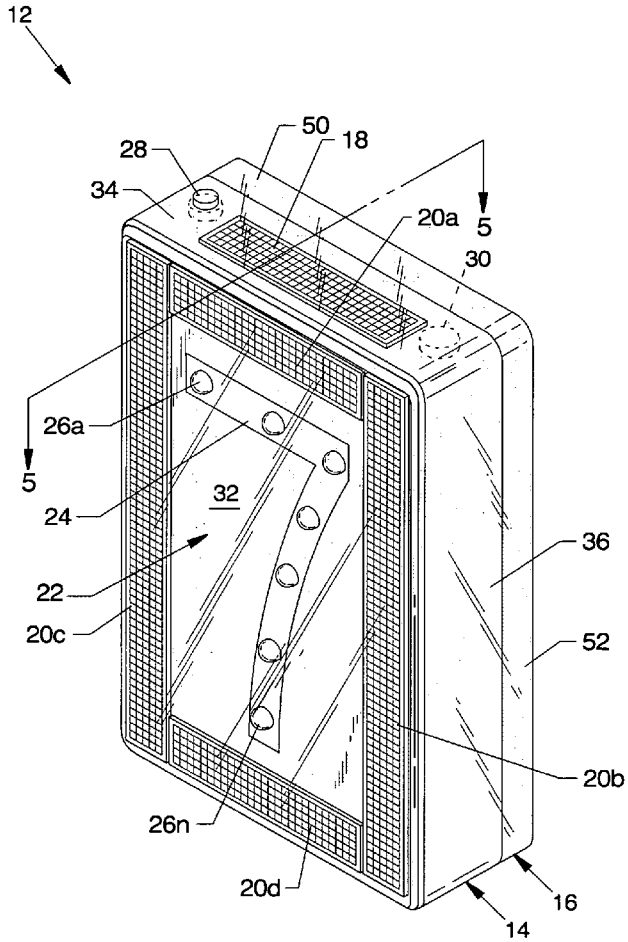
FIG. 2 is an isometric view of one of the similar modules comprising the modular solar powered illuminated alphanumeric identification system.

FIG. 2 is an isometric view of one of the similar modules 12 comprising the modular solar powered illuminated alphanumeric identification system 10. Readily viewable components include clear and transparent front and rear enclosures 14 and 16, respectively, of plastic or other suitable material, a horizontally disposed photovoltaic cell 18, and a plurality of vertically disposed photovoltaic cells 20*a*-20*d* secured within the front enclosure 14, and a printed circuit board 22 enclosed within the front enclosure 14 having a visible alphanumeric character 24 displayed, such as by printing, silk screening or the like, on the front surface of the printed circuit board 22, and more specifically, and for purposes of demonstration, the numeral 7. Other readily viewable components include a plurality of light emitting diodes 26*a*-26*n* enclosed within the front enclosure 14 which are mounted on and extend forwardly from the circuit board 22, as well as being co-located and distributed along and coinciding with the shape of the alphanumeric character 24. A power switch 28 is located extending through the front enclosure 14 and a light sensitive transistor 30 is located behind and within the front enclosure 14.

Figure 3:
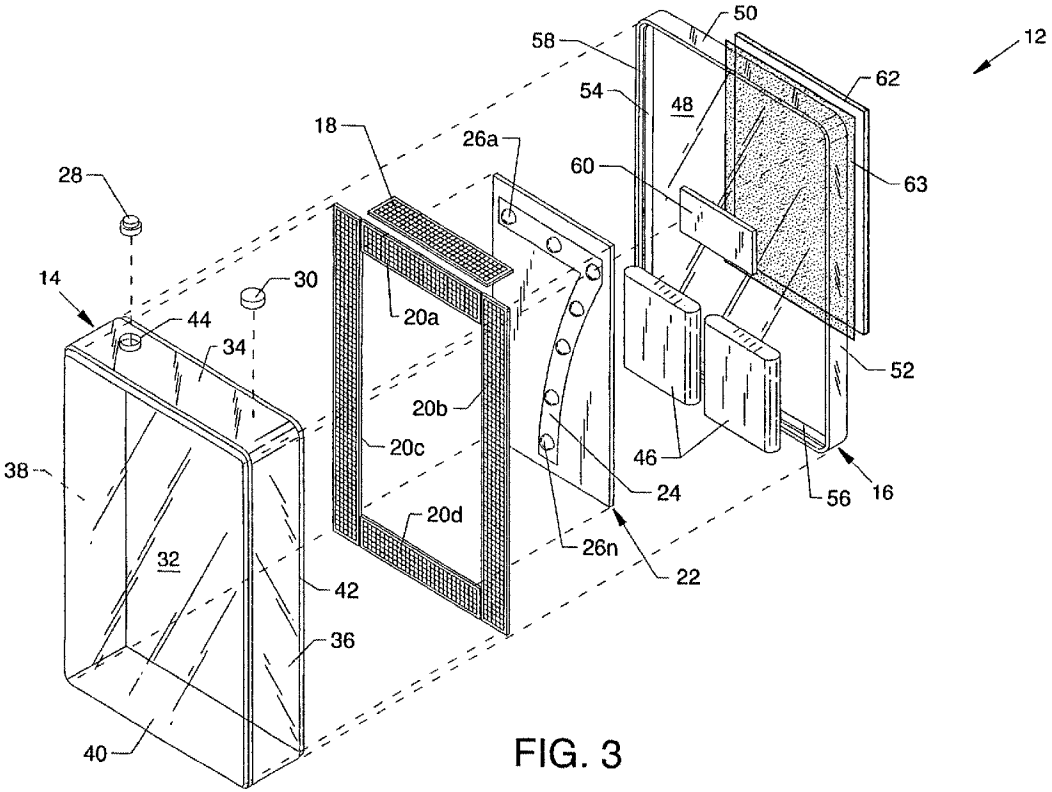
FIG. 3 is an exploded isometric view of one of the similar modules comprising the modular solar powered illuminated alphanumeric identification system shown in FIG. 2.

FIG. 3 is an exploded isometric view of one of the similar modules 12 comprising the modular solar powered illuminated alphanumeric identification system 10, previously shown in FIG. 2. The front enclosure 14 includes a front panel 32 and a plurality of panels extending rearwardly from the front panel 32 including a top panel 34, opposed side panels 36 and 38, and a bottom panel 40, each panel being clear and transparent. A continuous mating lip 42 is located at the rear edge of the top panel 34, the opposed side panels 36 and 38 and the bottom panel 40 for mating with the forward edge of the rear enclosure 16, as later described in detail. The power switch 28 extends through a hole 44 in the top panel 34 and is sealably mounted thereto. The horizontally disposed photovoltaic cell 18 is suitably secured, in close juxtaposition, to the top panel 34 and the plurality of vertically disposed photovoltaic cells 20*a*-20*d* is suitably secured, in close juxtaposition, to the front panel 32. Photovoltaic cell 18 receives ambient light through the top panel 34 and the plurality of photovoltaic cells 20*a*-20*d* receive ambient light through the front panel 32. The horizontally disposed photovoltaic cell 18 and the vertically disposed photovoltaic cells 20*a*-20*d* are mounted and juxtapositionly aligned in different planes and in three dimension style within the front enclosure 14 in order to receive incident ambient light at various angles for the purpose of recharging one or more rechargeable battery packs 46. The rear enclosure 16 includes a rear panel 48 and a plurality of panels extending forwardly from the rear panel 48 including a top panel 50, opposed side panels 52 and 54, and a bottom panel 56, each panel being clear and transparent. A continuous mating lip 58 is located at the front edge of the top panel 50, the opposed side panels 52 and 54, and the bottom panel 56 for mating of the rear enclosure 16 with the mating lip 42 at the rearward edge of the front enclosure 14. One or more electronics circuit board 60 is also included and suitably mounted, along with one or more battery packs 46, within the confines of the mated front enclosure 14 and rear enclosure 16. One panel of hook and latch material 62 is secured, such as by adhesive or other suitable means, to the rear panel 48 of the rear enclosure 16 which is quickly engageable to a complementary panel of hook and latch material (not shown) on a desired mounting surface to attach the module 12 to such a surface. In the alternative, other mounting methods, such as, but not limited to, double-sided adhesive tape could be used to attach the modules 12, or mounting holes could be provided extending suitably through the modules 12.

Figure 4:
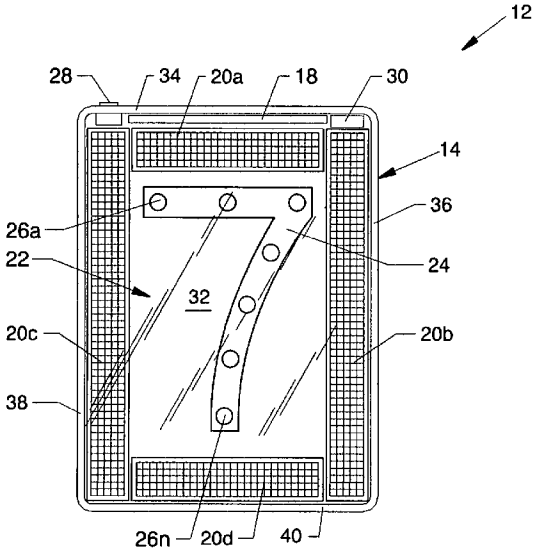
FIG. 4 is an assembled front view of one of the similar modules.

FIG. 4 is an assembled front view of one of the similar modules 12 showing the location and relationship of the photovoltaic cells 18, 20*a*, 20*b*, 20*c* and 20*d* behind the front panel 32 and within the front enclosure 14.

Figure 5:
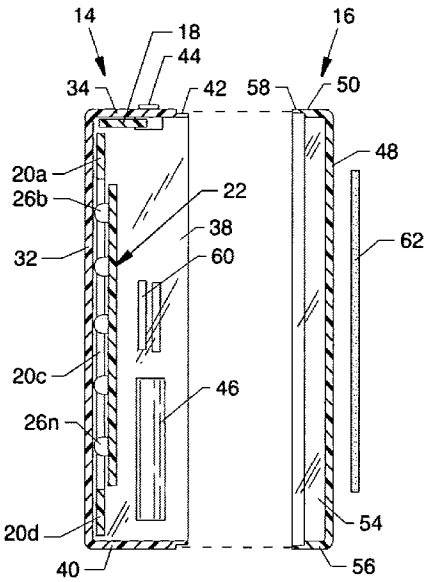
FIG. 5 is an exploded cross section view of one of the similar modules along line 5-5 of FIG. 2.

FIG. 5 is an exploded cross section view of one of the similar modules 12 along line 5-5 of FIG. 2 showing the location and relationship of the photovoltaic cells 20*a*, 20*c* and 20*d* behind the front panel 32, the location and relationship of the photovoltaic cell 18 behind the top panel 34, and the location and relationship of the printed circuit board 22 and plurality of light emitting diodes 26*a*-26*n* behind the front panel 32.

Figure 6:
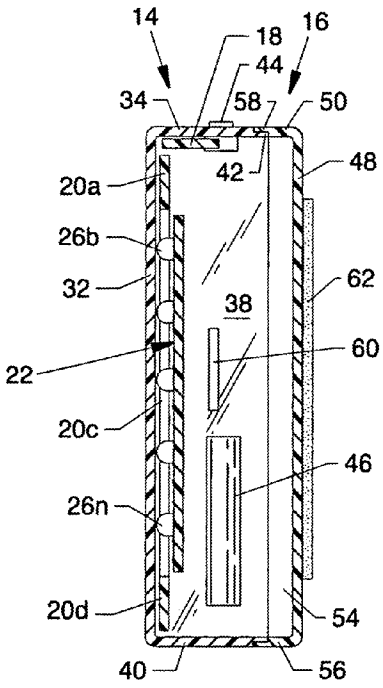
FIG. 6 is an assembled cross section view of the module of FIG. 5.

FIG. 6 is an assembled cross section view of the module 12 of FIG. 5. Shown in particular is the intimate engagement of the mating lips 42 and 58 of the front enclosure 14 and the rear enclosure 16, respectively, to form a watertight seal between the front enclosure 14 and the rear enclosure 16. In the alternative, an adhesive, electronic welding, snap engagement or the like may be used to complement the seal in lieu of the mating lips 42 and 58.

Figure 7:
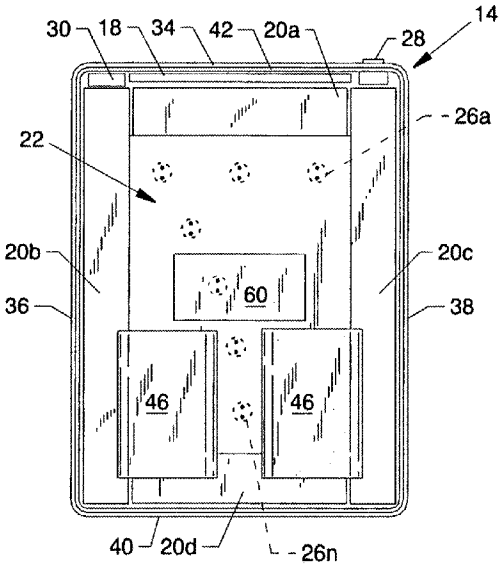
FIG. 7 is a rear view of one of the similar modules with the rear enclosure removed.

FIG. 7 is a rear view of one of the similar modules 12 with the rear enclosure 16 removed.

Figure 8:
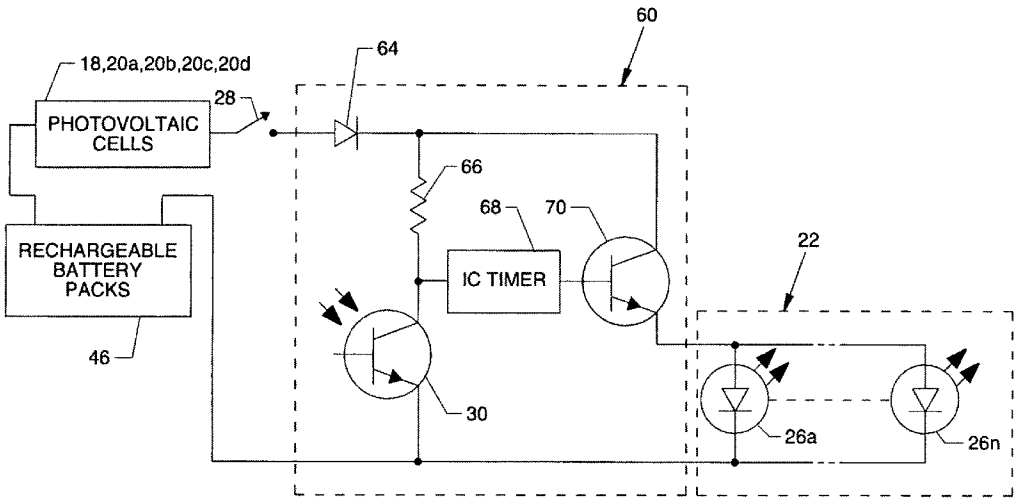
FIG. 8 is an electrical schematic for one of the similar modules.

FIG. 8 is an electrical schematic for one of the similar modules 12. The photovoltaic cells 18 and 20*a*, 20*b*, 20*c* and 20*d* preferably are connected in series or, in the alternative, can be connected in parallel or otherwise suitably connected to charge the rechargeable battery packs 46 during hours of available daylight. The power switch 28 enables functioning of the rechargeable battery packs 46 and photovoltaic cells 18, 20*a*, 20*b*, 20*c* and 20*d* through a diode 64 for use by components located on the circuit board 22, including, but not limited to, a resistor 66, a photoelectric cell, an IC timer 68, and a transistor 70. The photoelectric cell can provide ambient light sensing to discontinue illumination of the plurality of light emitting diodes during daylight hours, thereby enhancing battery pack life and duration; the photoelectric cell can comprise light sensitive transistor 30, for example. The IC timer 68 allows for a small delay in powering of the transistor 70 for subsequent powering of the light emitting diodes 26*a*-26*n* on the circuit board 22. Although the components referenced in FIG. 8 and other figures indicate the use of components which are located in several circuit boards or which are otherwise located, such components can be incorporated into one or more circuit boards and shall not be limiting to the scope of the invention.

Mode of Operation

The modular solar powered illuminated alphanumeric identification system 10 is configured for use by side-by-side placement of a plurality of modules 12, each having a unique and distinct numeral, letter alphabet or other suitable symbol, in a desired sequence to form and display a desired alphanumeric identification display. The hook and latch material 62 (as shown, for example, in FIG. 6) secured to the rear panel 48 on the rear enclosure 16 of each of the modules 12, is made to engage corresponding complementary hook and latch material located and suitably secured to the surface of a building, object, location, street sign, mailbox or the like, or other location where identification during day and night hours is desirable. Operation of each of the modules 12 is simply enabled by depressing the power switch 28, whereupon the circuitry described in FIG. 8 is enabled. When ambient sunlight is available, the photovoltaic cells 18 and 20*a*, 20*b*, 20*c* and 20*d* provide charging voltage for the charging of the rechargeable battery packs 46. During periods of sufficient ambient light, as sensed by the light sensitive transistor 30, flow of power to the light emitting diodes 26*a*-26*n* is interrupted by sensing of the status of available ambient light by use of the light sensitive transistor 30, thus allowing for maximum charging of the battery packs 46 without power usage. Correspondingly, power from the battery packs 46 is made available for illumination of the light emitting diodes 26*a*-26*n* when the light sensitive transistor 30 senses the lack of available ambient light. The IC timer 68 provides for a short delay of power delivery to the light emitting diodes 26*a*-26*n* in order to prolong the life of the battery packs 46.

Figure 9:
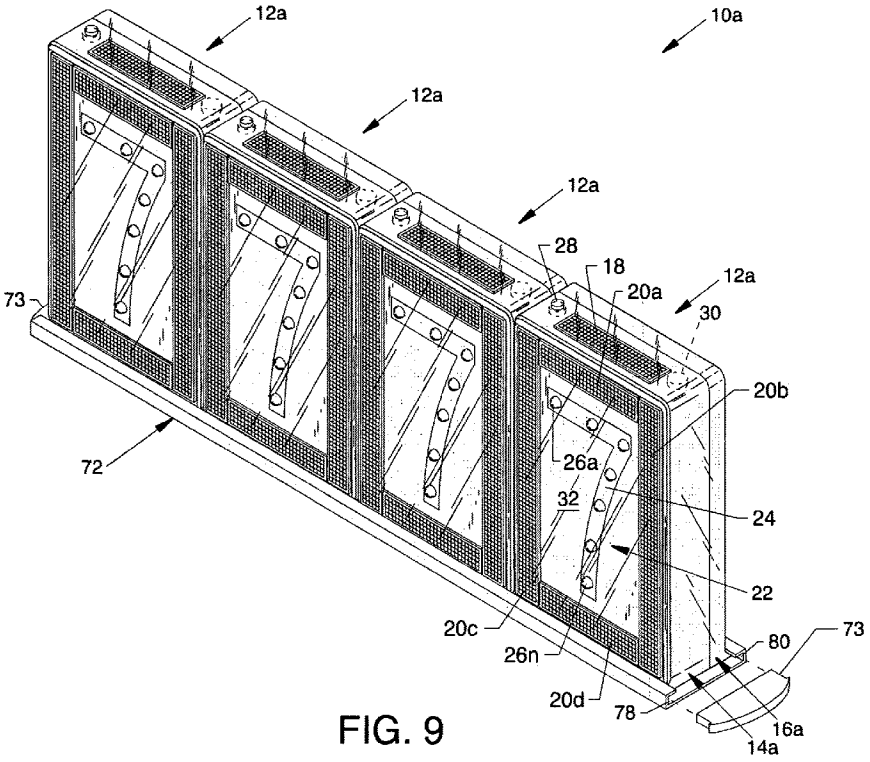
FIG. 9, a first alternative embodiment of the present invention, is an isometric view of a modular solar powered illuminated alphanumeric identification system.

FIG. 9, a first alternative embodiment of the present invention, is an isometric view of a modular solar powered illuminated alphanumeric identification system 10*a*, the present invention, including a plurality of like and similar modules 12*a* closely arranged side-by-side in an array where each module 12*a* is slideably mounted along and within a channel 72. The channel 72 accommodating the modules 12*a* can be attached to a horizontally disposed planar or other suitably oriented surface or location such as, but not limited to, the side of a house, a business, a mailbox, a business location or any other desired location. In this alternative embodiment, the modules 12*a* are equally viewable from two or more vantage points, i.e., from both the front and the rear, as well as parallax views of both the front and the rear. End caps 73 are provided for engagement with each end of the channel 72 for securing the modules 12*a* within the channel 72.

Figure 10A:
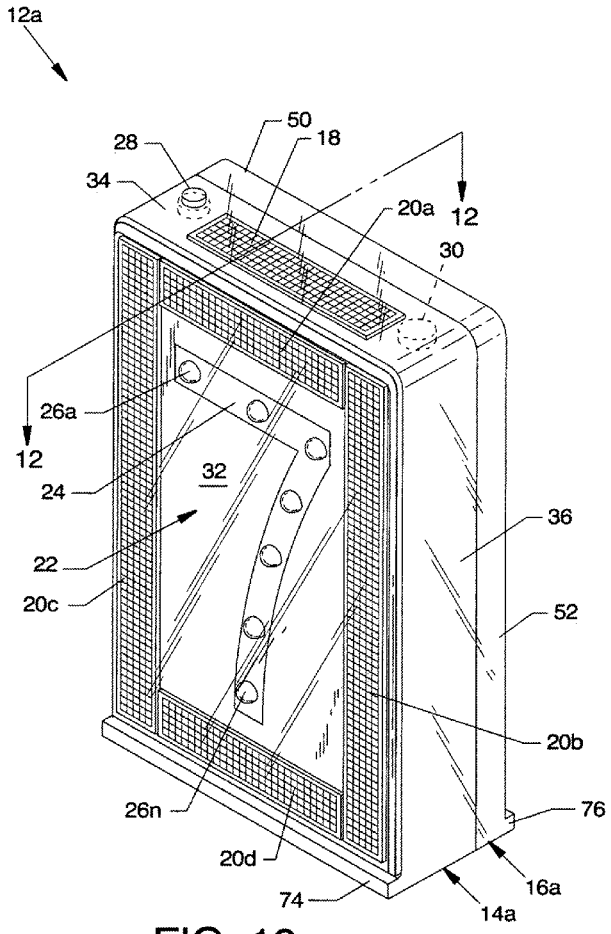
FIG. 10*a* and FIG. 10*b* illustrate a front isometric view and a rear isometric view, respectively, of one of the modules where the front and rear of the plurality of modules display suitably ordered alphanumeric characters.
Figure 10B:
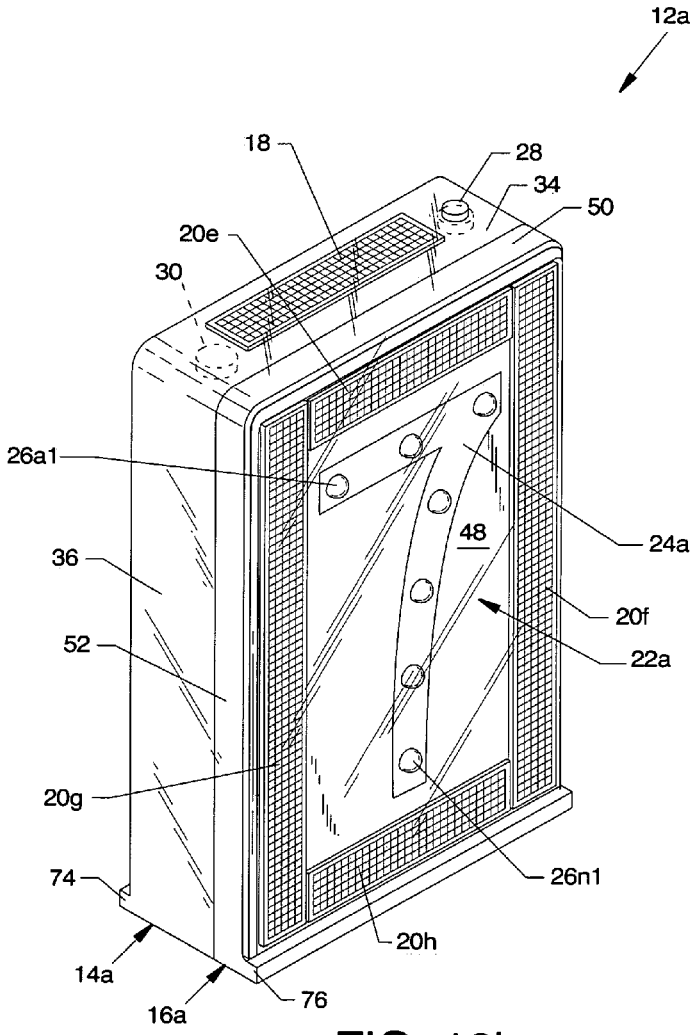

FIG. 10*a* and FIG. 10*b* illustrate a front isometric view and a rear isometric view, respectively, of one of the modules 12*a* where the front and rear sides of the plurality of modules 12*a* display suitable ordered alphanumeric characters. For purposes of illustration, the alphanumeric character 24 is displayed as a seven, but it is understood that the alphanumeric characters on both sides of the modules 12*a* comprising the modular solar powered illuminated alphanumeric identification system 10*a* may differ from that illustrated in order to maintain a properly ordered alphanumeric sequence suitably and correctly viewed and read from either the front or rear sides.

As shown in FIG. 10*b*, the rear panel 48 of the rear enclosure 16*a* characterizes and includes like and similar additional components, such as included and shown on the front panel 32 (FIG. 10*a*) of the enclosure 14*a* including, but not limited to, the photovoltaic cells 20*e*, 20*f*, 20*g* and 20*h*, a printed circuit board 22*a*, an alphanumeric character 24*a*, and light emitting diodes 26*a*1-26*n*1. A horizontally aligned tab 74 extends outwardly from the junction of the lower portion of the front panel 32 and the bottom panel 40 of the front enclosure 14*a*, and a horizontally aligned tab 76 extends outwardly from the junction of the lower portion of the rear panel 48 and the bottom panel 56 of the rear enclosure 16*a*, collectively shown in FIGS. 10*a* and 10*b*, to accommodate and slidingly engage the receptor slots 78 and 80, respectively, of the channel 72, shown in FIG. 9.

Figure 11:
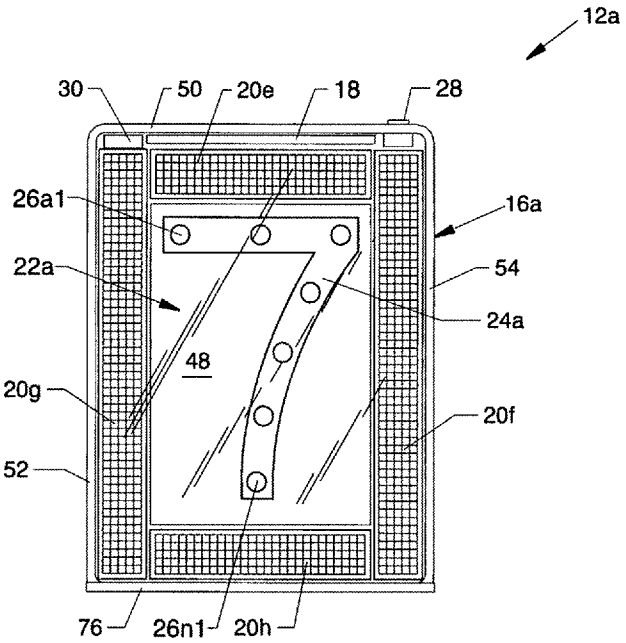
FIG. 11 is a rear view of one of the similar modules.

FIG. 11 is a rear view of one of the similar modules 12*a* showing the location and relationship of the photovoltaic cells 18, 20*e*, 20*f*, 20*g* and 20*h* located behind the rear panel 48 and within the rear enclosure 16*a*.

Figure 12:
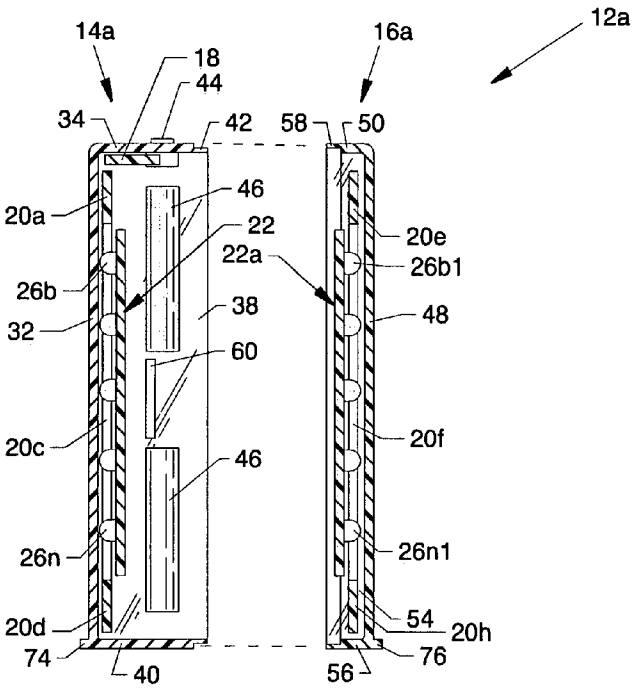
FIG. 12 is an exploded cross section view of one of the similar modules along line 12-12 of FIG. 10*a;*

FIG. 12 is an exploded cross section view of one of the similar modules 12*a* along line 12-12 of FIG. 10*a* showing the location and relationship of the photovoltaic cells 20*a*, 20*c* and 20*d* behind the front panel 32, the location and relationship of the photovoltaic cell 18 behind the top panel 34, and the location and relationship of the printed circuit board 22 and plurality of LEDs 26*a*-26*n* behind the front panel 32. Also shown is the location and relationship of the photovoltaic cells 20*e*, 20*f* and 20*h* behind the rear panel 48, and the location and relationship of the printed circuit board 22*a* and plurality of LEDs 26*a*1-26*n*1 behind the rear panel 48. Additional photovoltaic cells 20*e*-20*h* and additional battery packs 46 are included in order to power the light emitting diodes 26*a*1-26*n*1 of the printed circuit board 22*a*. Circuitry, including one or more electronics circuit board 60, may be required or expanded to accommodatingly operate the components of this alternative embodiment.

Figure 13:
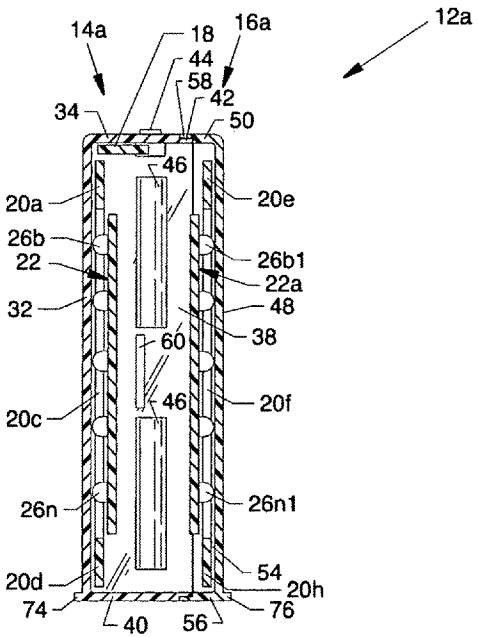
FIG. 13 is an assembled cross section view of the module of FIG. 12.

FIG. 13 is an assembled cross section view of one of the similar modules 12*a* of FIG. 12. Shown in particular is the intimate engagement of the mating lips 42 and 58 of the front enclosure 14*a* and the rear enclosure 16*a*, respectively, to form a watertight seal between the front enclosure 14*a* and the rear enclosure 16*a*. In the alternative, an adhesive, snap engagement, electronic welding or some similar means may be used to complement the seal offered by the mating lips 42 and 58.

Mode of Operation

The operation of the components of the first alternative embodiment is closely related to that of the first embodiment, especially the electrical features. Additional components are added to provide for viewing of the modules 12*b* from the front or the rear including a circuit board 22*a* having light emitting diodes 26*a*1-26*n*1 and the alphanumeric character 24*a*. Photovoltaic cells 20*e*-20*h* are also added to provide additional charging power for one or more battery packs 46 in order that all the light emitting diodes 26*a*1-26*n*1 may be suitably energized. The inclusion of the tabs 74 and 76 provides for quick mounting of a plurality of modules 12*a* via the channel 72 to a suitable surface.

Figure 14:
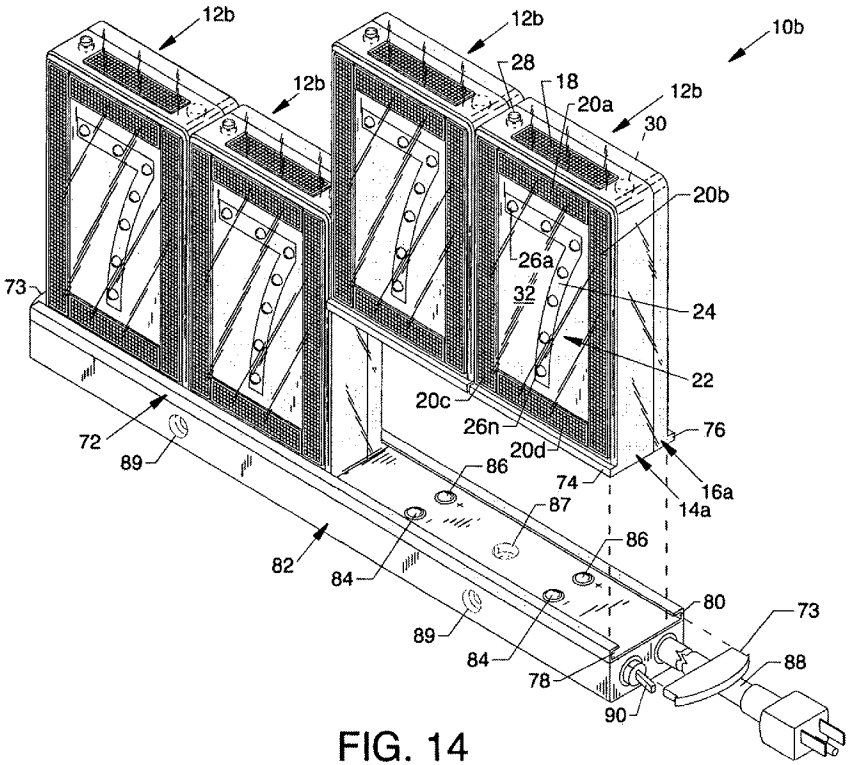
FIG. 14, a second alternative embodiment of the present invention, is an isometric view of a modular solar powered illuminated alphanumeric identification system; and, FIG. 15 illustrates the general and sensing circuitry of the auxiliary power module.

FIG. 14, a second alternative embodiment of the present invention, is an isometric view of a modular solar powered illuminated alphanumeric identification system 10*b*, the present invention, wherein a charging apparatus in the form of an auxiliary power module 82 is provided for supplemental use in periods of insufficient ambient sunlight. The auxiliary power module 82 is suitably mounted to and beneath channel 72 and provides an electrical charging current through a plurality of negative polarity charging contacts 84 and a plurality of positive polarity charging contacts 86 suitably and electrically insulated from, but extending through, channel 72. A power cord 88 is provided for connection to any suitable power source, such as provided by, but not limited to, home wiring or other power sources, preferably using eco-friendly sources such as wind power, large electrical grids, water power and the like. A power switch 90 is also provided for powering or depowering of the auxiliary power module 82, as desired. A plurality of modules 12*b* are provided which are similar to the previously described modules 12*a*, but each includes negative and positive contactors (not shown) extending through the bottom panel 40 of each module 12*b* for suitable contacting and engagement with the plurality of negative polarity charging contacts 84 and plurality of positive polarity charging contacts 86. Optionally, where alphanumeric display is desired on one side only, modules can be used with the powering features of this embodiment, such as by use of either a module which only includes light emitting diodes 26*a*-26*n* on the circuit board 22 or by use of a module which only includes light emitting diodes 26*a*1-26*n*1 on the circuit board 22*a*. A plurality of vertically oriented mounting holes, such as mounting hole 87, and a plurality of horizontally oriented mounting holes, such as mounting holes 89, are provided extending through the body of the auxiliary power module 82 for mounting of the auxiliary power module 82 to horizontally or vertically oriented surfaces, respectively. Optionally, an auxiliary power module, generally in the shape of a module 12*a* or 12*b*, could be provided which would slidingly engage the channel 72 to engage a pair of the negative polarity charging contacts 84 and positive polarity charging contacts 86 to power all of the negative polarity charging contacts 84 and positive polarity charging contacts 86.

Figure 15:
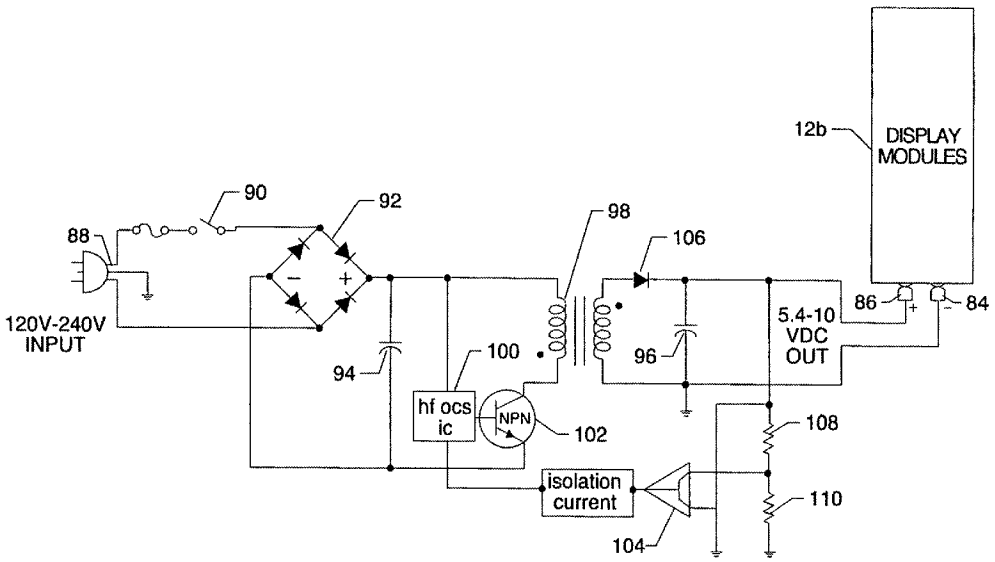

FIG. 15 illustrates the general and sensing circuitry for the auxiliary power module 82. Operating power is made available through the power cord 88 and switch 90 to a diode rectifier bridge 92, the output of which is connected to a plurality of other components which sense and provide charging of the display modules 12*b* when a low battery pack 46 voltage is sensed. Such components include capacitors 94 and 96, a transformer 98, an integrated circuit 100, a transistor 102, a voltage regulator integrated circuit 104, a diode 106, and resistors 108 and 110.

Mode of Operation

The operation of the components of the second alternative embodiment is closely related to that of the first and second embodiments. The auxiliary power module 82 adds to the versatility of the invention by providing the use of the photovoltaic cells 18 and 20*a*-20*h* by allowing the self-charging of the battery packs 46 during times of adequate ambient light for normal operation without assistance of the auxiliary power module 82 and, in the alternative, where sufficient ambient light is not available or nonexistent as sensed by low voltage by the circuitry of the auxiliary power module 82, the auxiliary power module 82 automatically supplies power to the modules 12*b*, whereby concurrent charging of the battery packs 46 and thus subsequent lighting of the light emitting diodes 26*a*-26*h* occurs.

Various modifications can be made to the present invention without departing from the apparent scope thereof.

| PARTS LIST | |
|---|---|
| 10 | modular solar powered illuminated alphanumeric identification system |
| 10a | modular solar powered illuminated alphanumeric identification system |
| 10b | modular solar powered illuminated alphanumeric identification system |
| 12 | module |
| 12a | module |
| 12b | module |
| 14 | front enclosure |
| 14a | front enclosure |
| 16 | rear enclosure |
| 16a | rear enclosure |
| 18 | photovoltaic cell |
| 20a-h | photovoltaic cell |
| 22 | printed circuit board |
| 22a | printed circuit board |
| 24 | alphanumeric character |
| 24a | alphanumeric character |
| 26a-n | light emitting diodes |

-continued

| PARTS LIST | |
|---|---|
| 26a1-n1 | light emitting diodes |
| 28 | power switch |
| 30 | light sensitive transistor |
| 32 | front panel |
| 34 | top panel |
| 36 | side panel |
| 38 | side panel |
| 40 | bottom panel |
| 42 | mating lip |
| 44 | hole |
| 46 | battery pack |
| 48 | rear panel |
| 50 | top panel |
| 52 | side panel |
| 54 | side panel |
| 56 | bottom panel |
| 58 | mating lip |
| 60 | electronics circuit board |
| 62 | hook and latch material |
| 64 | diode |
| 66 | resistor |
| 68 | IC timer |
| 70 | transistor |
| 72 | channel |
| 73 | end cap |
| 74 | tab |
| 76 | tab |
| 78 | receptor slot |
| 80 | receptor slot |
| 82 | auxiliary power module |
| 84 | negative polarity charging contact |
| 86 | positive polarity charging contact |
| 87 | mounting hole |
| 88 | power cord |
| 89 | mounting hole |
| 90 | switch |
| 92 | diode rectifier bridge |
| 94 | capacitor |
| 96 | capacitor |
| 98 | transformer |
| 100 | integrated circuit |
| 102 | transistor |
| 104 | voltage regulator integrated circuit |
| 106 | diode |
| 108 | resistor |
| 110 | resistor |

It is claimed:

1. An integral, sealed modular solar powered illuminated alphanumeric identification system comprising:

at least one module-comprising a front housing portion having a clear and transparent front enclosure and a rear housing portion having a clear and transparent rear enclosure, said front and rear housing portions together defining a sealed housing;

multiple components disposed within said sealed housing and comprising a printed circuit board having a numeral or letter located upon one of a front surface portion of the printed circuit board and a rear surface portion of the printed circuit board and respectively viewable through the front enclosure and the rear enclosure;

a plurality of light emitting diodes (LEDs) mounted to and positioned upon one of the front surface portion of the printed circuit board and the rear surface portion of the printed circuit board so as to coincide with the shape of the numeral or letter located thereon and respectively viewable through the front enclosure and the rear enclosure;

at least one photovoltaic cell disposed at one of various advantageous positions upon at least one of the front and rear enclosures;

at least one rechargeable battery pack disposed internally within said sealed housing;

at least one photoelectric cell; and circuitry for charging the rechargeable battery pack and for operation of the multiple components contained within said system, whereby said integral, sealed, modular, solar powered illuminated alphanumeric identification housing comprises a self-contained operative system.

2. The modular solar powered alphanumeric identification system as set forth in claim 1, further comprising:

a power switch secured to said transparent front enclosure and electrically connected between said at least one photovoltaic cell, said at least one rechargeable battery pack, and said printed circuit board whereby said at least one rechargeable battery pack is operative through said printed circuit board so as to energize said plurality of LEDs when said power switch is closed.

3. The modular solar powered illuminated alphanumeric identification system of claim 1, wherein:

a light sensitive transistor is secured to said transparent front enclosure and is electrically connected to said printed circuit board, said light sensitive transistor being dependent upon the light ambient condition so as to control the flow of power from said at least one rechargeable battery pack to said plurality of LEDs.

4. The modular solar powered illuminated alphanumeric identification system of claim 1, wherein:

said at least one solar powered alphanumeric modules comprises a plurality of solar powered alphanumeric modules aligned adjacently or horizontally with respect to each other.

5. The modular solar powered alphanumeric identification system as set forth in claim 1, wherein:

said front transparent enclosure comprises a front transparent panel, a top transparent panel, a bottom transparent panel, and opposite transparent side panels, all of said transparent panels of said front transparent enclosure defining a first box-shaped enclosure; and said rear transparent enclosure comprises a rear transparent panel, a top transparent panel, a bottom transparent panel, and opposite transparent side panels, all of said transparent panels of said rear transparent enclosure defining a second box-shaped enclosure.

6. The modular solar powered alphanumeric identification system of claim 5, wherein:

said top panel of said front transparent enclosure has a planar photovoltaic cell adjacent an inner surface thereof.

7. The modular solar powered alphanumeric identification system of claim 5, wherein:

a panel of hook and latch material is secured to a rear surface of said rear panel of said rear enclosure.

8. The modular solar powered alphanumeric identification system of claim 7, wherein:

said panel of hook and latch material is secured to a rear surface of said rear panel of said rear enclosure by an adhesive.

9. The modular solar powered alphanumeric identification system as set forth in claim 5, wherein:

said top, bottom, and side transparent panels of said first box-shaped enclosure have a first continuous lip or edge extending around the open side of said first boxshaped enclosure; and said top, bottom, and side transparent panels of said second box-shaped enclosure have a second continuous lip or edge extending around the open side of said second box-shaped enclosure for engaging said first continuous lip or edge extending around the open side of said first box-shaped enclosure so as to define said sealed housing when said first and second continuous lips or edges of said first and second box-shaped enclosures are joined together.

10. The modular solar powered alphanumeric identification system of claim 9, wherein:

said edges of said front and rear enclosures are joined together by one of an adhesive, snap engagement structure, and electronic welding.

11. The modular solar powered alphanumeric identification system as set forth in claim 1, wherein:

said at least one photovoltaic cells comprises a plurality of photovoltaic cells.

12. The modular solar powered alphanumeric identification system as set forth in claim 11, wherein:

said plurality of photovoltaic cells are disposed within a frame-shaped array of photovoltaic cells.

* * * * *